United States Patent [19]

Maykemper

[11] 4,266,892

[45] May 12, 1981

[54] HYDRAULIC ROOF-SUPPORT FRAME

[75] Inventor: Alfred Maykemper, Wuppertal, Fed. Rep. of Germany

[73] Assignee: Hermann Hemscheidt Maschinenfabrik GmbH & Co., Wuppertal, Fed. Rep. of Germany

[21] Appl. No.: 53,833

[22] Filed: Jul. 2, 1979

[51] Int. Cl.[3] ..... E21D 17/02

[52] U.S. Cl. ..... 405/293; 405/291

[58] Field of Search ..... 405/294, 295, 291, 302, 405/293; 299/31, 33; 248/357; 91/170 MP

[56] References Cited

U.S. PATENT DOCUMENTS 3,732,699 5/1973 Stevenson ..... 405/294

FOREIGN PATENT DOCUMENTS 2319930 11/1974 Fed. Rep. of Germany ..... 405/293

2705461 5/1978 Fed. Rep. of Germany ..... 405/294

2727414 11/1978 Fed. Rep. of Germany ..... 405/293

*Primary Examiner*—Dennis L. Taylor

*Attorney, Agent, or Firm*—Berman, Aisenberg & Platt

[57] ABSTRACT

The roof-engaging assembly of a support frame for a mine roof comprises a main beam having a cantilever extension pivoted to the main beam by pins. In order to pivot the cantilever extension through an angle of about 180°-200° between a stowed position and an operative position, a link is pivoted at one point to the main beam and is pivoted at another point to one end of a double acting jack. The other end of the jack is pivoted to the main beam so that, by extending or retracting the jack, the link member pivots one way or the other. The cantilever extension has a pin which runs in a slot in the link member, the arrangement being such that pivoting of the link member by the jack produces pivoting of the cantilever extension through a much larger angle, e.g., double the angle.

6 Claims, 5 Drawing Figures

Fig. 2.
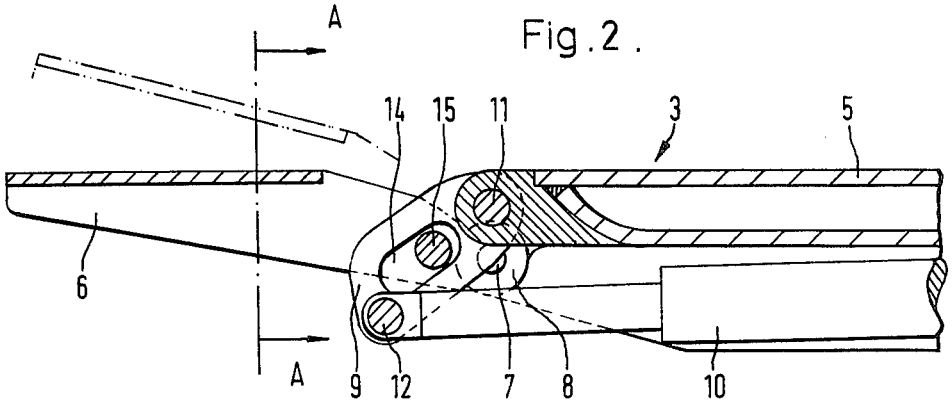
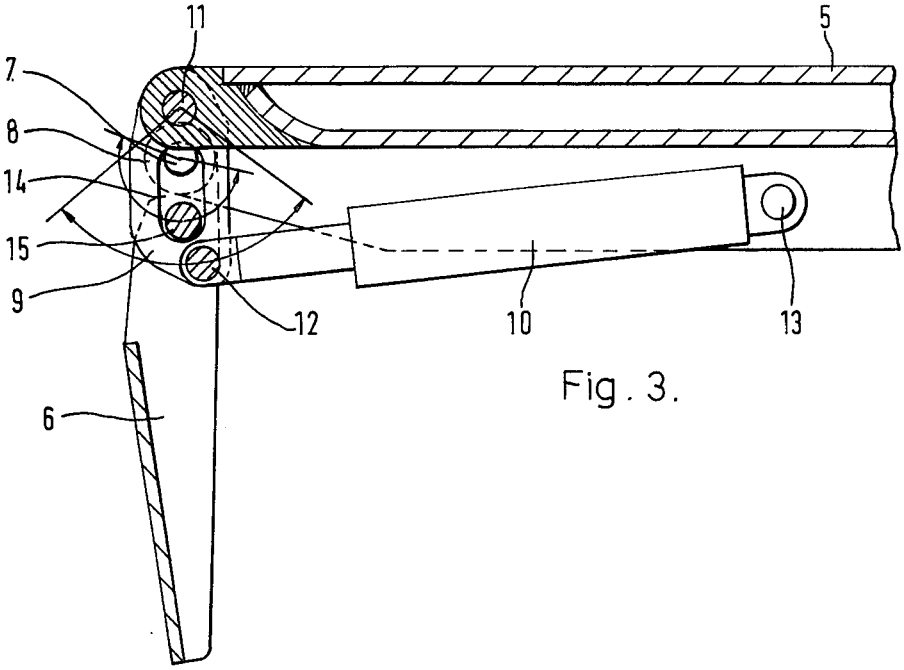
Fig. 3.
Fig. 4.
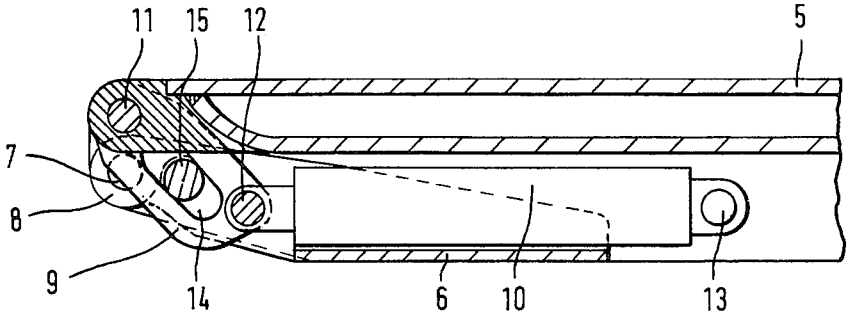

HYDRAULIC ROOF-SUPPORT FRAME

This invention relates to an hydraulic roof-support frame for use in supporting a mine roof at a working face (for example, a coal face) the roof-supporting frame comprising a base, a roof-engaging assembly, and extensible and retractable hydraulic props extending between the base and the roof-engaging assembly for urging the roof-engaging assembly against a roof.

It is already known (see German Gebrauchsmuster No. 1,907,015) to construct the roof-engaging assembly of the frame in two parts, namely a main roof-engaging structure connected to the upper ends of the props, and an auxiliary roof-engaging structure mounted on the main roof-engaging structure for pivotal movement about a generally horizontal axis to form a cantilever extension of the main roof-engaging structure. In one known construction the auxiliary roof-engaging structure can be pivoted through an angle of about 180° between a stowed position and an operative position. In its stowed position the auxiliary roof-engaging structure lies folded back beneath the main roof-engaging structure in contact with the underside of the main roof-engaging structure. In its operative position the auxiliary roof-engaging structure extends outwardly from the main roof-engaging structure to assist in supporting a roof, and if the roof is flat the auxiliary roof-engaging structure will form a co-planar extension of the main roof-engaging structure. If, however, the roof is uneven, the auxiliary roof-engaging structure, when in its operative position, may slope upwardly or downwardly from the main roof-engaging structure.

In the said known construction, the auxiliary roof-engaging structure is pivoted between its stowed and operative positions by means of an extensible and retractable hydraulic jack or ram pivotally connected at one end to the auxiliary roof-enaging structure at a point mid-way between the free edge of the auxiliary roof-engaging structure and the said horizontal pivot axis. The other end of the jack is pivotally connected to one of the props.

In order to move the auxiliary roof-engaging structure from its operative to its stowed position, the jack is retracted until the auxiliary roof-engaging structure has pivoted through about 130°. At this time the pivot points at the ends of the jack are in line with the pivot axis of the auxiliary roof-engaging structure, and the jack itself lies in the plane of the auxiliary roof-engaging structure in an opening in the structure, such opening extending from the pivot connection between the jack and the auxiliary roof-engaging structure to the free edge of the auxiliary roof-engaging structure. This is a "dead centre" position in which the jack cannot exert a pivoting force on the auxiliary roof-engaging structure. From this "dead centre" position the auxiliary roof-engaging structure is pushed manually towards its stowed position, whereupon the jack can be extended to urge the auxiliary roof-engaging structure against the underside of the main roof-engaging structure.

The construction described above has the serious disadvantage that operation of the auxiliary roof-engaging structure cannot be entirely remote controlled because it needs to be manually assisted through its "dead centre" position. Another disadvantage is that, in moving the auxiliary roof-engaging structure from one position to the other, the jack movement is not unidirectional, i.e., the jack must be retracted and then extended.

One way of overcoming the first-mentioned disadvantage has been proposed in our earlier German patent application No. 2,727,414 filed on June 18, 1977, and also in the corresponding British patent application No. 16929/78 filed on April 28, 1978, the corresponding U.S. patent application Ser. No. 904,287 filed on May 9, 1978, and the corresponding South African patent application No. 78/2640 also filed on May 9, 1978. According to these earlier Applications, the auxiliary roof-engaging structure is pivotable between its end positions by means of a pair of hydraulically operated retractable and extensible jacks pivotally connected at one end thereof to the auxiliary roof-engaging structure and pivotally connected at their other end to the main roof-engaging structure, the respective positions at which the jacks are pivotally connected to the auxiliary roof-engaging structure being angulary spaced from one another relative to the said pivot axis of the auxiliary roof-engaging structure. It will be appreciated that the two jacks can never be in their "dead centre" positions simultaneously, so that the auxiliary roof-engaging member can be pivoted through at least 180° by remote control. However, the proposal is expensive because of the necessity to provide two jacks instead of one jack and because of the need to provide the complicated valve gear for the jacks, which jacks must be extended and retracted at different times from each other during pivoting of the auxiliary roof-engaging structure between its end positions.

It is an aim of the present invention to provide an hydraulic roof-support frame of the general kind described above in which the auxiliary roof-engaging structure can be pivoted between its said positions (which may, for example, be between 180° and 200° apart) without the need for manual movement thereof, without the need to provide two jacks, and avoiding a "dead centre" position of the jack, whereby the auxiliary roof-engaging structure can be pivoted from one end position to another with unidirectional jack movement, i.e., either extension or retraction of the jack but not both, during a single pivoting movement of the auxiliary roof-engaging structure.

With the above aim in view, the invention is directed to an hydraulic roof-support frame comprising:

(a) a base assembly;

(b) a roof-engaging assembly;

(c) extensible and retractable hydraulic props extending between the roof-engaging assembly and the base assembly for raising and lowering the roof-engaging assembly, the roof-engaging assembly comprising a main roof-engaging structure connected to upper ends of the props and an auxiliary roof-engaging structure mounted on the main roof-engaging structure for pivoted movement about a generally horizontal axis between a stowed position in which it lies folded back beneath the main roof-engaging structure and an operative position in which it extends outwardly from the main roof-engaging structure in a position to assist in supporting a roof;

(d) a double-acting hydraulic jack or ram; and (e) a link member which serves to transmit movement between the jack and the auxiliary roof-engaging structure, the link member being pivotally connected at a first end region thereof to the main roof-engaging structure and being pivotally connected at a second and opposite end region thereof to one end of the jack, a second and opposite end of the jack being pivotally connected to the main roof-engaging structure so that movement of the jack pivots the link member about its pivotal connection with the main roof-engaging structure, the link being drivingly connected with the auxiliary roof-engaging structure, the arrangement being such that pivotal movement of the link member through a first given angle produces pivotal movement of the auxiliary roof-engaging structure through a second and larger angle whereby pivotal movement of the auxiliary roof-engaging structure from one of its said positions to its other said position can be effected by unidirectional movement of the jack.

A preferred embodiment of the invention will now be described by way of example and with reference to the accompanying drawings, in which:

FIG. 2 is a cross-sectional side view of the roof-engaging assembly of FIG. 1, showing an auxiliary roof-engaging structure in an operative position thereof;

FIG. 3 is a view similar to FIG. 2, but showing the auxiliary roof-engaging structure moved half-way towards a stowed position thereof;

FIG. 4 is a view similar to FIG. 3, but showing the auxiliary roof-engaging structure in its stowed position.

Figure 1:
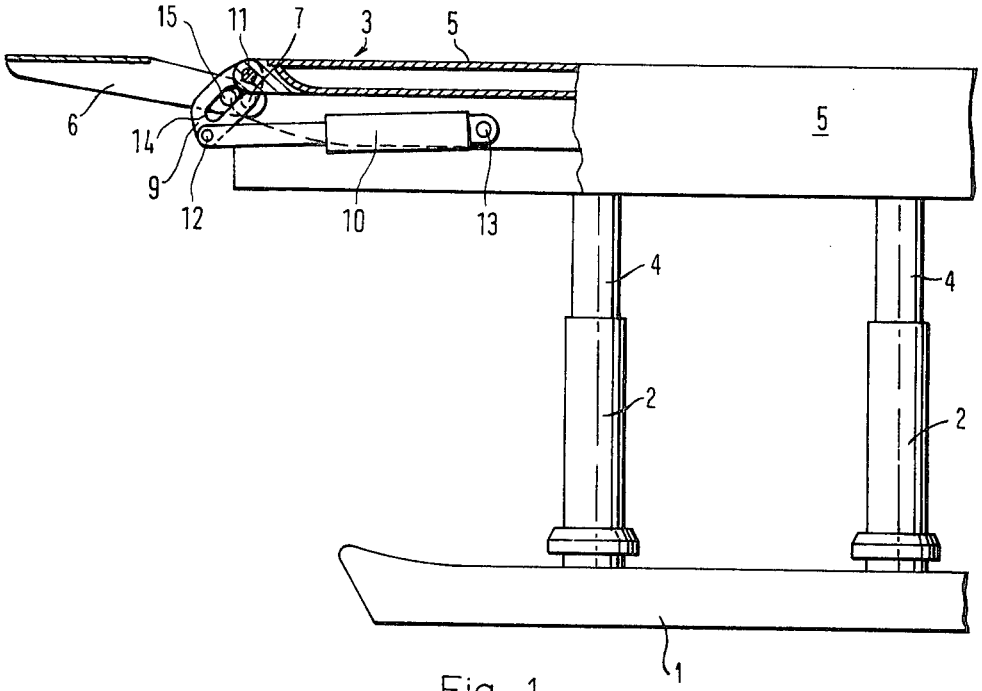
FIG. 1 is a side view in partial cross-section of a part of a walking roof-support frame according to the invention, the view showing a roof-engaging assembly supported from a base assembly via props.

FIG. 1 shows an hydraulic roof-support frame having a base assembly comprised by a one-piece base 1 on which hydraulically extensible and retractable props 2 are mounted. Instead of the arrangement shown, the base assembly could comprise individual base shoes, one on the bottom of each prop. A roof-engaging assembly 3 is mounted on the pistons 4 of the props 3, the props serving for raising and lowering the roof-engaging assembly and for urging it against a roof (not shown).

The roof-engaging assembly comprises a main roof-engaging structure 5 (referred to in the following description as a "main beam" for convenience) mounted directly on the pistons 4, and an auxiliary roof-engaging structure (referred to in the following description as a "cantilever beam"). The cantilever beam 6 is mounted for pivotal movement on the main beam 5 on pivot pins 7 which are mounted in respective spaced-apart aligned bearings 8 disposed on the main beam 5. The cantilever beam 6 is arranged to pivot about the pins 7 between a stowed position and an operative position. In its stowed position (FIG. 4) the cantilever beam 6 lies folded back beneath the main beam 5 in contact with the underside thereof. In its operative position (FIGS. 1 and 2) the cantilever beam 6 extends outwardly from the main beam 5 to assist in supporting a roof. If the roof is flat, the cantilever beam 6 will lie in an end position in line with the main beam 5 as shown in full lines in FIG. 2, but if the roof is uneven, the cantilever beam may slope upwardly from the main beam as shown in chain dotted lines in FIG. 2.

Figure 5:
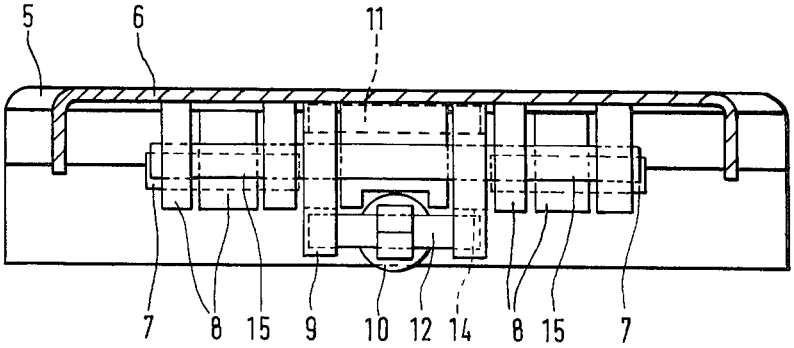
FIG. 5 shows a cross-section taken on the line A—A in FIG. 1.

The mechanism for pivoting the cantilever beam 6 between its end positions comprises a link member 9 and a double acting jack 10. An upper end of the link member 9 is pivotally mounted on the main beam 5 by means of a pivot 11 which is disposed directly above the pivots 7 as seen in FIGS. 2 to 4, and between the pivot bearings 8 as seen in FIG. 5. The lower end of the link member 9 is pivotally connected by a pivot 12 to the piston of the jack 10. The cylinder of the jack 10 is pivotally connected to the main beam 5 at pivot pin 13. The link member 9 is formed with a central slot 14 extending in a direction between its pivot points 11 and 12. A driving connection between the link member 9 and the cantilever beam 6 is established by means of a horizontal pin member 15 which is rigid with the cantilever beam 6 and extends through the slot 14 in the link member 9.

In order to move the cantilever beam 6 from its stowed position, which may entail pivoting of the beam 6 through an angle of between 180° and 200°, it is merely necessary to move the jack 10 unidirectionally, i.e., to retract it. This causes the link member 9 to pivot anticlockwise (as viewed in FIGS. 1 to 4) about pivot 5 through an angle of between 90° and 100°. As the link member 9 pivots, the pin member 15 is pulled and forced to pivot about the pins 7 in bearings 8, thus causing the cantilever beam 6 to pivot about pins 7. As the cantilever beam pivots, the pin member 15 moves down the slot 14 to the bottom thereof (FIG. 3) and then back up the slot again.

In the embodiment described, the cantilever beam 6 can be pivoted through an angle of approximately 200°, as shown by the arrows in FIG. 3. By means of the effective "doubling" of the pivot angle, the presence of a "dead centre" position which was the main cause of the disadvantages of the known constructions has been avoided.

Also, movement of the cantilever beam from one of its positions (i.e., stowed position or operative position) to its other position can be achieved by a continuous, i.e., unidirectional movement of the single jack 10. Of course, to extend the cantilever beam 6 from its stowed (FIG. 4) position to its operative (FIG. 2) position, it is merely necessary to extend the jack.

What is claimed is:

1. An hydraulic roof-support frame comprising:

(a) a base assembly;

(b) a roof-engaging assembly;

(c) extensible and retractable hydraulic props extending between the roof-engaging assembly and the base assembly for raising and lowering the roof-engaging assembly, said roof-engaging assembly comprising a main roof-engaging structure connected to upper ends of the props and an auxiliary roof-engaging structure mounted on the main roof-engaging structure for pivotal movement about a generally horizontal axis between a stowed position in which it lies folded back beneath the main roof-engaging structure and an operative position in which it extends outwardly from the main roof-engaging structure in a position to assist in supporting a roof;

(d) a double acting extensible and retractable hydraulic jack operable unidirectionally to effect pivotal movement of the auxiliary roof-engaging structure from one of its said positions to the other; and (e) a drive linkage operatively connecting said jack to said auxiliary roof-engaging structure, said drive linkage including a link member pivotally connected at a first end region thereof to the main roof-engaging structure at a point above said generally horizontal axis and pivotally connected at a second and opposite end region thereof to one end of said jack, a second and opposite end of the jack being pivotally connected to the main roof-engaging structure so that movement of the jack pivots the link member about its pivotal connection with the main roof-engaging structure, said pivotal link being drivingly connected with the auxiliary roof-engaging structure by a pin-and-slot mechanism comprising a pin slidable along a slot, one of said pin and said slot being provided on the link member and the other of said pin and said slot being provided on said auxiliary roof-engaging structure, movement of the link member through a first given angle producing pivotal movement of the auxiliary roof-engaging structure through a second and larger angle.

2. An hydraulic roof-support frame comprising:

(a) a base assembly;

(b) a roof-engaging assembly;

(c) extensible and retractable hydraulic props extending between the roof-engaging assembly and the base assembly for raising and lowering the roof-engaging assembly, said roof-engaging assembly comprising a main roof-engaging structure connected to upper ends of the props and an auxiliary roof-engaging structure mounted on the main roof-engaging structure for pivotal movement about a generally horizontal axis between a stowed position in which it lies folded back beneath the main roof-engaging structure and an operative position in which it extends outwardly from the main roof-engaging structure in a position to assist in supporting a roof;

(d) a double acting hydraulic jack; and (e) a link member which serves to transmit movement between the said jack and said auxiliary roof-engaging structure, the link member being pivotally connected at an upper end region thereof to the main roof-engaging structure at a point above said generally horizontal axis and being pivotally connected at a lower end region thereof to one end of said jack, a second and opposite end of the jack being pivotally connected to the main roof-engaging structure so that movement of the jack pivots the link member about its pivotal connection with the main roof-engaging structure, the link being drivingly connected with the auxiliary roof-engaging structure, unidirectional extension movement of the jack pivoting the link through a first angle to drive the auxiliary roof-engaging structure to pivot through a second and larger angle from its stowed position to its operative position.

3. An hydraulic roof-support frame as claimed in claim 2 in which the auxiliary roof-engaging structure is pivotally connected to the main roof-engaging structure at two aligned spaced-apart bearings, and in which the link member is pivotally connected to the main roof-engaging structure at a region disposed between, but not aligned with, the said two spaced-apart bearings.

4. An hydraulic roof-support frame as claimed in claim 2, in which the driving connection between the link member and the auxiliary roof-engaging structure comprises a horizontal pin member mounted on the auxiliary roof-engaging structure, said pin running in a slot in the link member, said slot extending in a direction between the said end regions of the link member.

5. An hydraulic roof-support frame as claimed in claim 2, in which the auxiliary roof-engaging structure is pivotable through an angle of approximately 200°.

6. An hydraulic roof-support frame as claimed in claim 5, in which pivoting of the auxiliary roof-engaging structure through 200° is effected by movement of the link member through approximately 100°.

* * * * *